United States Patent [19]

Nakamura et al.

[11] 4,252,434

[45] Feb. 24, 1981

[54] METHOD AND APPARATUS FOR CONVEYING DEVELOPING AGENT

[75] Inventors: Shunji Nakamura, Kawasaki; Tsutomu Toyono, Tokyo, both of Japan

[73] Assignee: Canon Kabushiki Kaisha, Tokyo, Japan

[21] Appl. No.: 2,727

[22] Filed: Jan. 11, 1979

[30] Foreign Application Priority Data

Jan. 17, 1978 [JP] Japan ..... 53-3492

[51] Int. Cl.[3] ..... G03G 15/00; G03G 15/09; G03G 13/09

[52] U.S. Cl. ..... 355/15; 134/1; 198/690; 355/3 DD; 430/125

[58] Field of Search ..... 355/3 R, 3 DD, 14 D, 355/15; 118/652, 657, 658; 198/690; 430/120, 122, 125; 134/1, 9

[56] References Cited

U.S. PATENT DOCUMENTS

| | | | |
|---|---|---|---|
| 3,882,821 | 5/1975 | Katayama et al. | 355/3 DD X |
| 3,927,937 | 12/1975 | de Keyzer | 355/15 |
| 3,951,542 | 4/1976 | Ito et al. | 118/652 X |
| 3,983,841 | 10/1976 | Norton | 118/652 |
| 4,006,987 | 2/1977 | Tomono et al. | 355/15 |
| 4,008,686 | 2/1977 | Katakura et al. | 118/651 |
| 4,097,140 | 6/1978 | Suzuki et al. | 355/15 |
| 4,131,357 | 12/1978 | Forbes | 355/3 DD |

*Primary Examiner*—Fred L. Braun

*Attorney, Agent, or Firm*—Fitzpatrick, Cella, Harper & Scinto

[57] ABSTRACT

A method and apparatus for conveying developing agent for use in an image forming apparatus, in which a magnetic developer is placed under the influence of a forcing magnetic field, then the developer restrained by the forcing magnetic field is caused to pass through a slit-passageway having a narrowing clearance, thereafter the developer is pushed out into a conveying path by reducing the intensity of the forcing magnetic field to the developer which has passed through the minimum clearance in the slit-passageway below the magnetic field in the minimum clearance section of the slit-passageway, and finally the developer which has been pushed out into the conveying path is moved in and through the conveying path by being further pushed by subsequently transported developer. The apparatus is basically constructed with a magnetic developer conveying device having a magnetic power source to impart moving force to the magnetic developer, and a guide member disposed adjacent to the magnetic developer conveying device to guide the magnetic developer in substantially an upward direction.

33 Claims, 11 Drawing Figures

METHOD AND APPARATUS FOR CONVEYING DEVELOPING AGENT

BACKGROUND OF THE INVENTION

1. Field of the Invention

This invention relates to a method and apparatus for conveying developing agent, or developer. More particularly, it is concerned with a method and an apparatus capable of readily conveying magnetic developer for developing a latent image on an image bearing member.

2. Description of Prior Arts

There have heretofore been proposed various types of image forming device which form and utilize a developed image. Such image forming devices have been in practical use.

Widely used in particular is a type, in which an electrostatic latent image is formed on a photosensitive member based on the electrophotographic method, and the latent image is developed for the image formation. Besides this, there have also been used a system, in which an electrostatic image is formed on an insulative surface in accordance with a signal from an electrostatic pin electrode, or a system, in which an electrostatic latent image is formed on a screen photosensitive member having therein a multitude of openings, and then ion current is modulated in accordance with the latent image, thereby forming an electrostatic image on an insulative surface, followed by its development for the image formation.

In the image forming device of a type, in which a developed image is obtained by use of a developer, disposal of the developer constitutes an important factor for the operating efficiency of the device. In particular, when an image bearing member, on which a developed image is formed, is repetitively used, such disposal becomes significant from the standpoint of recovery and re-use of the developer.

It has so far been the practice that the developer which remains after the image transfer operation on the image bearing member in the above-described type of image forming device is separated and removed from the image bearing member by a cleaning device such as a blade, a fur brush, a web, and so forth.

In the case of the web cleaning, the removed developer is adhered onto the web, which functions as a conveyor for the developer, as it is moved by a forwarding mechanism at the time of the cleaning. The transportation of the developer by the web, however, requires a driving mechanism for unwinding and winding of the web, and also necessitates, along with such mechanism, a considerable amount of space for the web to be unwound and wound after recovery of the developer. Moreover, re-use of the developer adhered onto the web is difficult in that separation of the developer off the web is fairly troublesome, and fabrics constituting the web are liable to mix the developer as separated therefrom.

In the case of the fur brush cleaning, there has been widely practiced that the removed developer is conveyed into a filter pack from the cleaning section by a suction mechanism through a conveying duct. When using the suction mechanism, however, a high-powered suction fan or impeller is required for obtaining sufficient suction force, hence it is inevitable that the suction mechanism becomes large in size to occupy a considerable space. Furthermore, re-use of the developer accumulated in the filter pack is difficult as is the case with the web cleaning.

In the case of the blade cleaning, there has been adopted such a construction that a cleaning blade is provided at the side surface of the photosensitive drum, the developer as scraped off the drum surface is recovered into a receptacle provided at the lower part of the drum by gravity, and then it is discharged sidewise by means of a screw conveyor. There has also been adopted such a construction that the cleaning blade is disposed at an upper part of the photosensitive drum, a guide member is contiguously provided to the cleaning blade, and the removed developing agent is discharged sidewise by a screw conveyor disposed in a space gap formed by the blade and the guide member. The developer as discharged sidewise in the above-described manner is guided to a receptacle provided at a lower position by gravity fall, for recovery and re-use.

While utilization of gravity is preferable in that no driving source for the conveying device is required, the direction for the recovery is limited to the downward direction accompanied by a considerable space for the gravity fall of the removed developer, hence its range of utility has been limited to some extent. In addition, there is apprehension such that the falling developer is liable to scatter in all directions to adhere to the surface of the photosensitive body or other process means, hence preventive measures there against should be taken in some occasion. In particular, when the electrophotographic device is to be miniaturized in size, the abovementioned limitation brings about a serious obstacle which could not be expected in a large-sized device.

While the screw conveyor is compact in size and shape as the conveying device, as it operates to convey the material under pressure of the screw disposed within a groove or tubing, it is disadvantageous in that the removed developer is liable to be solidified in transit. Besides the screw conveyor, there can be contemplated a system of circulatory movement of a number of buckets, or a belt conveyor system. These systems, however, require unavoidably a returning path for the circulating buckets and belt with the consequence that a considerable space is necessary including the driving mechanism therefor.

SUMMARY OF THE INVENTION

In view of the above-described various disadvantages inherent in the conventional techniques in conveying the removed developing agent, it is a primary object of the present invention to provide a conveying method and a device for the developer which is compact in size and is not liable to cause solidification of the developer during its transportation, hence effective utilization in an image forming device utilizing magnetic developer.

It is another object of the present invention to provide a conveying method and a device for the developer capable of conveying such developing agent with a simple and compact structure.

It is still another object of the present invention to provide a conveying method and a device for the developer capable of conveying magnetic developer in an upward direction including the substantial verticality.

In one aspect of the present invention, the developer conveying method to be applied to the image forming apparatus which forms a developed image on an image bearing member using magnetic developer comprises a step of placing magnetic developer under the influence of a forcing magnetic field; a step of causing the developer restrained by the forcing magnetic field to pass through a slit-passageway with a narrowed gap; a step of pushing the developer out into a conveying path by reducing the intensity of the forcing magnetic field to the developer which has passed through the minimum clearance in said slit-passageway below the magnetic field in said minimum clearance section of the slit-passageway; and a step of moving the developer which has been pushed out into said conveying path in and through the conveying path by being further pushed by subsequent developer.

In another aspect of the present invention, the developer conveying device is basically constructed with a magnetic developer conveying device having a magnetic power source to impart moving force to the magnetic developer, and a guide member disposed in contiguity to the magnetic developer conveying means to guide the magnetic developer in a substantially upward direction. In other words, the magnetic developing agent is transported into the guide member by the magnetic developer conveying device, by the conveying action of which the developer which has arrived at the guide member is further pushed upward to attain the intended function and resulting effect.

It has been known that there are two kinds of developer, the one is a binary component developer containing a carrier and toner particles, and the other is a single component developer which does not contain the carrier. Since the single component developer does not require density adjustment as the binary component developer, it is easy to handle, hence this type of developer has become widely used recently. The present invention uses both binary component developer containing a magnetic carrier and a single or binary component type developer containing a magnetic toner.

DESCRIPTION OF PREFERRED EMBODIMENTS

In the following, the present invention will be described in detail in reference to the preferred embodiments shown in the accompanying drawing, in which the same parts are designated by the same reference symbols and numerals.

Figure 1:
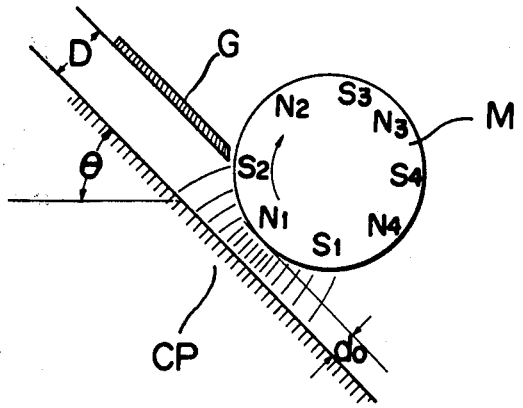
FIG. 1 is a side view for explaining the basic construction of the developer conveying device according to the present invention.

Referring first to FIG. 1, a magnetic roller M having a plurality of magnetic poles is rotatably held on a shaft and rotated in an arrow direction by a driving source (not shown).

In confrontation to this magnetic roller M, there is disposed an opposite magnetic pole plate CP. A slit-passageway having the minimum clearance of $d_0$ is formed between this opposite magnetic pole plate CP and the magnetic roller M. At the exit side of this slit-passageway corresponding to the rotational direction of the magnetic roller, there is disposed a guide plate G confronting to an extended surface of the opposite magnetic pole plate CP to form a conveying path. The clearance D between the guide plate G and the extended surface of the opposite magnetic pole plate CP is made greater than the minimum clearance $d_0$ of the slit-passageway.

Magnetic developer existing at the inlet side of the slit-passageway between the magnetic roller and the opposite magnetic pole plate (i.e., lower right side of the magnetic roller in the drawing) passes through the slit-passageway as the magnetic roller rotates in the arrow direction, and moves into the developer conveying path in the upper left side of the magnetic roller in the drawing. By continuously transporting the developer from the slit-passageway into the conveying path, the developer accumulated in the conveying path further travels upward along the path.

The mechanism of transporting the developer in the above-described manner will be explained as follows.

First of all, at the inlet side of the slit-passageway, the magnetic pole of the magnetic roller M comes close to the opposite magnetic pole plate CP by its rotation, i.e., in the state of the magnetic pole $S_1$ in the drawing. By the presence of the magnetic pole plate CP, the magnetic field intensity due to the magnetic pole $S_1$ abruptly increases to form a forcing magnetic field. Then, the developer existing in the magnetic field is brought to a bridged state along a magnetic line of force extending from the magnetic pole $S_1$ to the opposite magnetic pole plate CP. With rotation of the magnetic roller M, the clearance between the magnetic pole of the roller and the opposite magnetic pole plate becomes narrower, whereby the magnetic field intensity increases. The magnetic field intensity reaches its maximum at the minimum clearance section (i.e., the position of the magnetic pole $N_1$ in the drawing), whereby the bridging of the developer forced by the magnetic field is brought to a strongly compressed state. On the other hand, at the exit side of the slit-passageway, the magnetic roller is moving away from the opposite magnetic pole plate, hence the forcing magnetic field becomes gradually weakened. As a result, the developer is pushed out from the exit side of the slit-passageway where the forcing magnetic field has become weak. Incidentally, the inter-relationship between the forcing magnetic field and the developer particles when it is pushed out, or mutual functional relationship among the developer particles or the developers are yet to be clarified. It is, however, reasonable to consider for the better understanding of the abovementioned phenomenon that the bridged portion of the developer under a weak forcing magnetic field at the exit side of the slit-passageway pushes the bridged portion of the developer immediately preceding it by the compression deformation of the bridged portion of the developer which has arrived later at the minimum clearance section, or imparts an indirect influence thereto, whereby the bridged portion of the developer under this weak forcing magnetic field escapes from this restraint and travels forward. As is apparent from the above, the developer conveying method according to the present invention forms a forcing magnetic field to restrain the magnetic developer, and the intensity of this forcing magnetic field is increased, while it is being moved. Thereafter, by weakening the forcing magnetic field intensity, an extruding force is given to the magnetic developer. By utilization of this extruding force, the developer is conveyed. It is desirable that the conveying path be of such a construction that lowers friction resistance so as not to reduce the extruding force imparted to the developer. Also, the angle of arrangement of the guide plate should preferably be made such that the internal space of the path may be gradually widened toward the exit for favorable conveying result.

Figure 2:
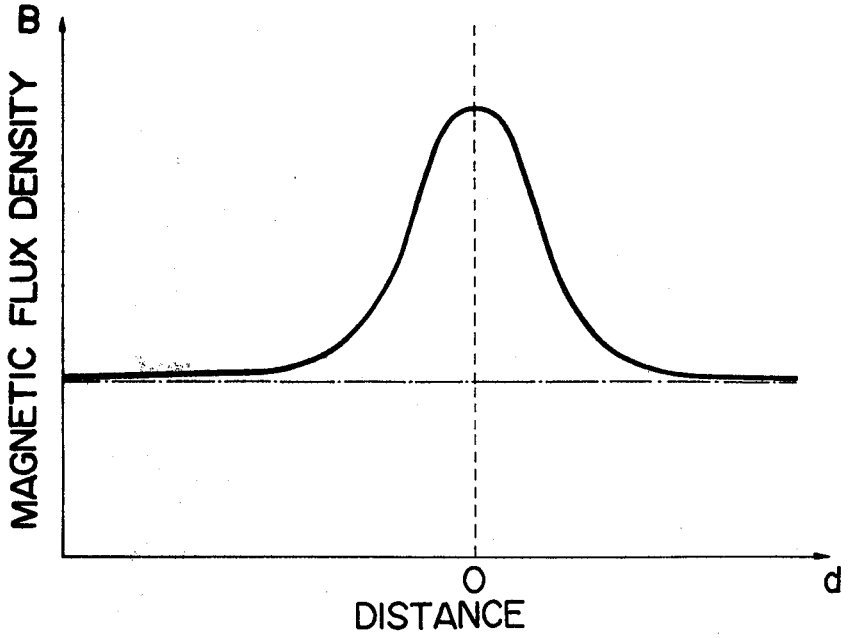
FIG. 2 is a graphical representation showing a magnetic characteristic for explaining a spatial magnetic flux density distribution on a magnetic roller.

Referring to FIG. 2 which is a graphical representation of the magnetic characteristic for explaining the spatial magnetic density distribution of the magnetic roller. In the graph, the dot-and dash line shows a case, wherein no opposite magnetic pole plate is provided, and the solid line curve indicates a case, wherein the opposite magnetic pole plate is disposed (in the case of the illustrated graphical representation, the opposite magnetic pole plate is in a cylindrical form). The magnetic flux density shown on the axis of the ordinate is at the surface position of the opposite magnetic pole plate with respect to the magnetic roller. The distance shown on the axis of the abscissa indicates positional changes between the magnetic roller surface and the magnetic pole plate surface with the magnetic pole plate surface which takes the shortest distance with the magnetic roller as a reference point.

As is apparent from the drawing, by disposing the opposite magnetic pole plate in the confronting space of the magnetic roller, the forcing magnetic field is formed in this opposite space. For the opposite magnetic pole plate to be arranged in confrontation to the magnetic roller, there may be used those materials having a tendency to be readily magnetized. It is also possible to use an opposite magnet which has been magnetized previously as a magnetic roller to be described hereinafter. The shape of the opposite magnetic pole plate is usually planar. Besides this, it may be formed in a convex shape with respect to the magnetic roller. Or, inversely, it may be shaped in a concave form so as to cover a part of the outer periphery of the magnetic roller. In other cases, it may be properly shaped in a roller form.

Figure 3:
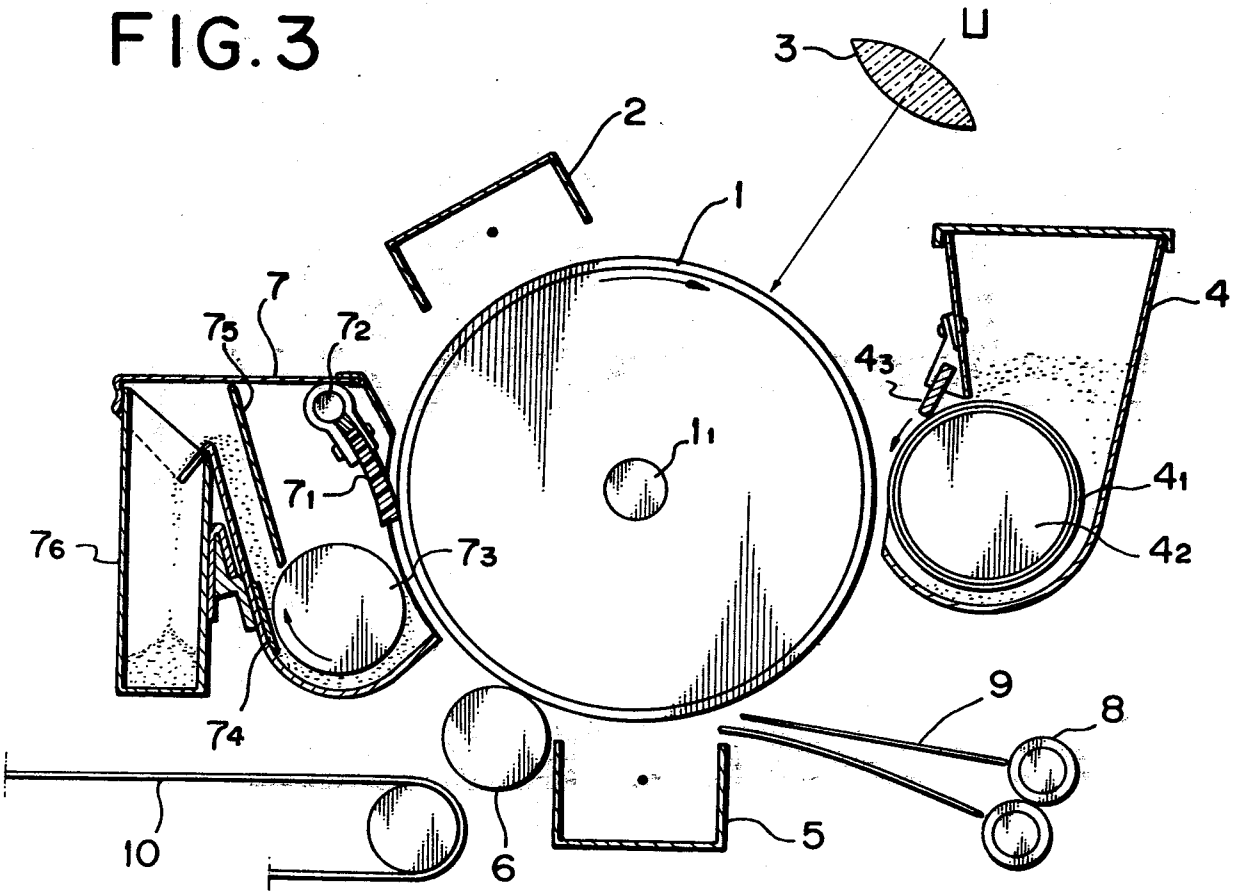
FIG. 3 is a side elevational view of one embodiment of the image forming device, to which the present invention is applied.

FIG. 3 shows one concrete example of an image forming apparatus, in which the cleaning device utilizing the developer conveying method according to the present invention is incorporated. The illustrated image forming apparatus is to form an electrostatic latent image based on the electrophotographic process, and then to develope the same.

In the drawing, a reference numeral 1 designates a photosensitive drum which is rotatably held on a supporting shaft $1_1$ and rotated in an arrow direction by a driving means (not shown). Around the upper portion of the outer periphery of the photosensitive drum 1, there are provided a corona discharger 2 to uniformly charge the surface of the photosensitive drum, an optical system 3 to expose an original light image L to be reproduced, a developing device 4 to develope an electrostatic latent image on the photosensitive drum, an image transfer corona discharger 5 to transfer the developed image onto an image transfer medium, a separating roller 6 to separate the image transfer medium, a cleaning device 7, and so forth. At the lower position of the photosensitive drum, there are disposed guide rollers 8 to feed the image transfer medium into an image transfer position, guide plates 9, and a conveying mechanism such as a conveyor belt 10 to transport the image transfer medium to an image fixing device after it has been image-transferred and separated from the image transfer position.

In the illustrated apparatus, the developing device 4 to develop the electrostatic latent image formed on the photosensitive drum is the so-called magnetic sleeve type developing device, in which a magnetic roller $4_2$ is accommodated in a nonmagnetizable sleeve $4_1$ rotating in an arrowed direction, and the magnetic developer is thinly coated on the surface of the sleeve $4_1$ by means of an adjusting blade $4_3$ disposed on the upper position of the sleeve to serve for the development.

Most of the developed image formed on the photosensitive drum is transferred onto the image transfer material, although there still remains on the photosensitive drum surface a quantity of the developing agent, and this residual developer is scraped off by the cleaning device 7 as follows.

The cleaning device 7 is disposed at a position where the photosensitive drum rotates upwardly, and a resilient cleaning blade $7_1$ is made to contact the drum surface in a direction opposite to the rotational direction of the photosensitive drum. The resilient cleaning blade $7_1$ is oscillatably fitted at one end thereof to a supporting shaft $7_2$, and its contact onto the surface of the photosensitive drum is maintained by a fixing means (not shown). A housing for the cleaning device is in an illustrated form made of a non-magnetizable material such as, for example, aluminum. At a lower part in this housing, there is disposed a magnetic roller $7_3$ for conveying the developer. The housing at the bottom side in the vicinity of the magnetic roller $7_3$ is provided with a curvature to follow the peripheral shape of the magnetic roller, thereby forming a conveying path for the developer. A magnetizable member $7_4$ to be the opposite magnetic pole plate is disposed on the side wall of the housing in close proximity to the magnetic roller to form a slit-passageway. Along this upwardly extending side wall, a guide plate $7_5$ is provided to define an upward conveying space for the developer in the cleaning device. The top part of the side wall which is in parallel with the guide plate $7_5$ is folded back to form a discharge opening for the developer. A receptacle $7_6$ for recovering the developer as discharged is joined at its top opening with the discharge opening at the top of the side wall, and engaged with the side wall of the apparatus main body by an engaging member.

By the above-described construction, the residual developing agent on the photosensitive drum is first scraped off by the resilient cleaning blade, and falls off the drum surface onto the surface of the magnetic drum $7_3$ or into the bottom of the housing of the cleaning device, and then is moved along the rotational direction of the magnetic drum within the developer conveying path following rotation of the magnetic roller. The developer which is being conveyed passes through the slit-passageway, and functions to thrust the advancing developer into the space for the upward transportation of the developer. The developer which has pushed the advancing developer into the space is in turn pushed into this space by the subsequent developer to be further advanced upward along the side wall, and finally falls down into the receptacle $7_6$ for recovering the discharged developer from the discharge opening. Therefore, the developer which has been pushed upward through the slit-passageway can be accumulatively conveyed into the recovering vessel $7_6$ until it overflows from the top opening. This signifies that the recovering vessel has excellent space saving property. In other words, the recovering vessel contiguous to the side wall of the cleaning device has its depth corresponding to that of the cleaning device main body which has been slightly extended, and it is not necessary to extend its width beyond that of the cleaning device proper in the breadthwise direction of the photosensitive drum. Also, the height of the vessel can be set arbitrarily, hence it can be set in accordance with the space surrounding the vessel. As the result, the recovery vessel has good space saving property within the image forming apparatus.

Figure 4:
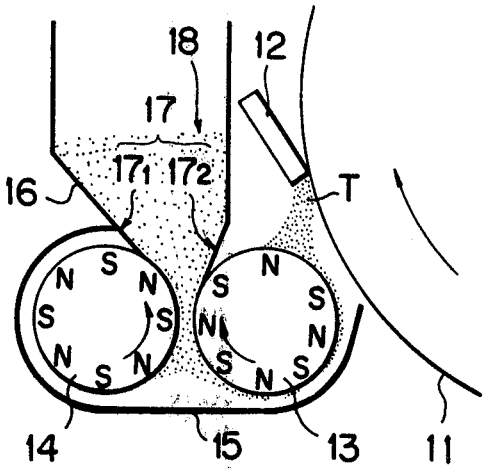
FIG. 4 is a schematic side elevational view of one embodiment of the developer conveying device according to the present invention.

FIG. 4 is a side elevational view of one concrete embodiment of the developer conveying device according to the present invention. In this illustrated embodiment, the removed developer is recovered and transported at the lower part of the photosensitive drum cleaning device in the electrophotographic apparatus which develops an electrostatic latent image using a magnetic developer.

In the drawing, the photosensitive drum 11 rotates in the arrow direction. The surface of this photosensitive drum 11 is contacted with a resilient cleaning blade 12 made of a resilient material such as urethane rubber, etc. to remove with its edge the residual developer on the surface of the photosensitive drum, whereby the developer falls down. A magnetic roller 13 is disposed in a freely rotatable manner in the vicinity of the cleaning section and at a position where the falling magnetic developer is attracted thereto. This magnetic roller 13 is rotated by a driving mechanism (not shown) in the arrow direction.

On the other hand, another magnetic roller 14 is arranged also in a rotatable manner maintaining a certain clearance with the magnetic roller 13. The magnetic pole of the magnetic roller 14 is arranged in such a manner that it may be opposed to that of the magnetic roller 13, i.e., S in the magnetic roller 14 and N in the magnetic roller 13, or vice versa. Since the magnetic roller 14 constituting the opposite polarity is magnetically restrained in accordance with movement of the magnetic roller 13, the former rotates in the arrow direction without necessity for an independent driving mechanism therefor, although it may, of course, be driven independently. A casing 15 covering the lower part of the magnetic rollers 13 and 14 constitutes a receptacle for the falling developer so that it may be prevented from scattering outside the device.

A guide member 16 is provided on the upper part of both magnetic rollers. The bottom end of the guide member 16 contacts each of the magnetic rollers 13 and 14 to constitute a scraper 17 (including parts $17_1$ and $17_2$ ) to separate the developer on the surface of the magnetic rollers. Accordingly, the developer as removed from the photosensitive drum surface by the resilient cleaning blade is attracted to the surface of the magnetic roller 13 due to its magnetic force without scattering, and is moved into a space between the magnetic roller 13 and the magnetic roller 14 constituting the opposite magnetic pole in accordance with rotation of the roller 13. By the action of this opposite magnetic pole, the developer adhered onto the surface of the roller moves upwardly irrespective of the quantity of the developer accumulated in the guide member 16. The developer on the magnetic rollers which have further advanced is scraped off by the action of the scrapers $17_1$ and $17_2$ and pushed into the guide member 16. The developer also moves upward by the thrust of the subsequently transported developer, and thus is accumulated in a bin 18 for storing the developer.

Figure 5:
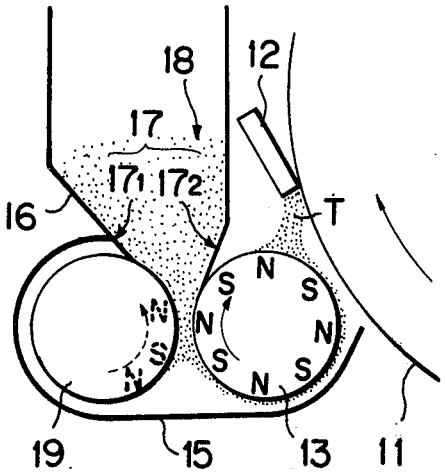
FIGS. 5, 6, 7 and 8 are, respectively, schematic side elevational views of modified embodiments of the developer conveying device according to the present invention.

FIG. 5 shows another embodiment of the developer conveying device according to the present invention. In this illustrated embodiment, there is provided, in place of the magnetic roller 14 in FIG. 4, a magnetizable roller 19 made of a magnetizable material having no magnetic polarity. In this magnetizable roller 19, there is induced an opposite magnetic polarity as shown by a dash line in accordance with the magnetic field in the magnetic roller 13. Accordingly, the magnetic roller 19 may be in a fixed construction without necessity for rotation, thereby attaining the function and resulting effect in the same degree as in the magnetic roller 14. When the surface of the magnetic roller 19 tends to readily cause frictional resistance against movement of the developer, rotation of the roller in an arrow direction as shown by a broken line may be effective.

In only a single illustrated construction, since the magnetic roller is used, the manufacturing cost of the device is less.

Figure 6:
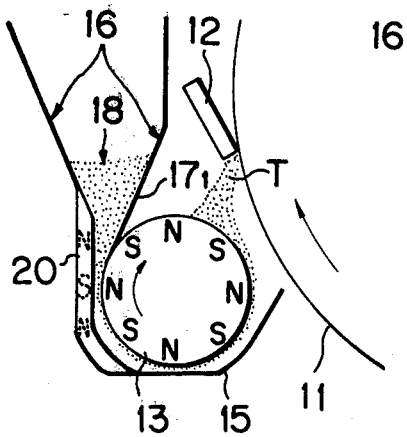

FIG. 6 shows a further modification of the developer conveying device, in which a magnetizable plate member 20 made of a magnetizable material is used in place of the magnetic roller 14 shown in FIG. 5. This magnetizable plate member 20 induces the opposite magnetic polarity as in the case with the magnetic roller 19 in FIG. 5, in accordance with the polarity of the magnetic roller 13 to satisfactorily assist the developer conveying function of the magnetic roller 13. In the illustrated embodiment, the entire device is very compact in size in comparison with a case, wherein the space at the side of the magnetizable plate member 20 is occupied by a roller. Moreover, since only a scraper is used, i.e. for the magnetic roller 13, the number of component parts used may be reduced, which also enables a simple construction of the device to be realized.

Figure 7:
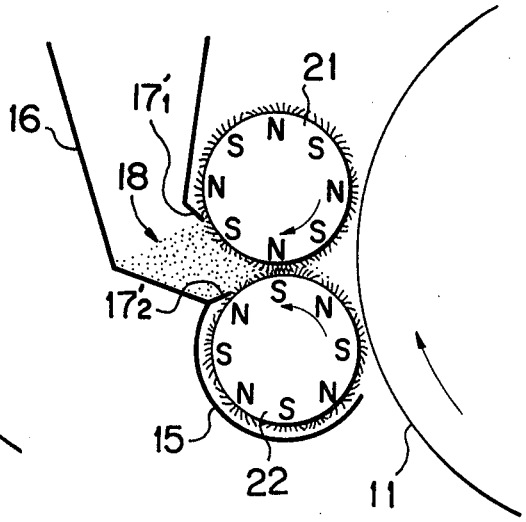

FIG. 7 shows still another modification of the developer conveying device according to the present invention, in which the magnetic rollers are given the surface cleaning function. That is, magnetic rollers 21 and 22 are arranged at mutually adjacent positions along the peripheral surface of the photosensitive drum 11, and each of the magnetic rollers is rotated in the an arrowed direction of the corresponding arrow. On the other hand, both ends $17_1'$ and $17_2'$ of the guide member 16 are not closely contacted to the surface of the rollers 21 and 22, but kept slightly spaced therefrom so that a small gap may be formed to provide a magnetic brush of a desired thickness in this gap, and that a quantity of the developer adhered onto the rollers in a thickness exceeding this brush thickness may be scraped off by the edges of the guide member, thereby realizing a scraper construction which performs the so-called ear-cutting function.

The residual developer on the photosensitive drum 11 is subjected to the magnetic brush cleaning by the magnetic brush provided on the surface of each magnetic roller, and adheres onto each roller to be forwarded to the guide member 16. The developer moving along the guide member 16 is pushed upwardly by the subsequently transported developer, and accumulated in the toner bin 18.

Figure 8:
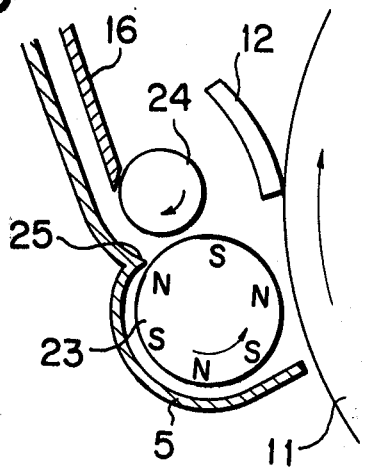

FIG. 8 shows further modification of the developer conveying device according to the present invention, wherein a magnetic roller 23 is disposed at a position where it receives the developer as removed from the photosensitive drum surface by the resilient cleaning blade 12, and another magnetic roller 24 made of a magnetizable material such as iron, etc. is disposed just above the roller 23, each being rotated in the direction of the corresponding arrow. In the illustrated embodiment, since the magnetic roller 23 is contiguous to the photosensitive drum and moves in the forwarding direction of the photosensitive drum along its peripheral surface, sufficient cleaning effect can also be exhibited. In other words, the magnetic brush is provided on the surface of the magnetic roller 23, and a preliminary cleaning is performed by a scraper 25 of a non-mgnetizable material integrally formed with the housing 5 in advance of the cleaning by the resilient cleaning blade 12. By such construction, coarse adherent such as small pieces of image transfer paper, etc. can be removed beforehand by this scraper 25, and the resilient cleaning blade can devote itself to removal of the developer electrostatically adhered onto the drum surface, hence its working efficiency is improved remarkably. In addition, since the magnetic roller 23 and the other roller 24 of magnetizable material such as iron are cooperatively rotating, the conveying function of the developer further improves as is the case with the other embodiments.

Figure 9:
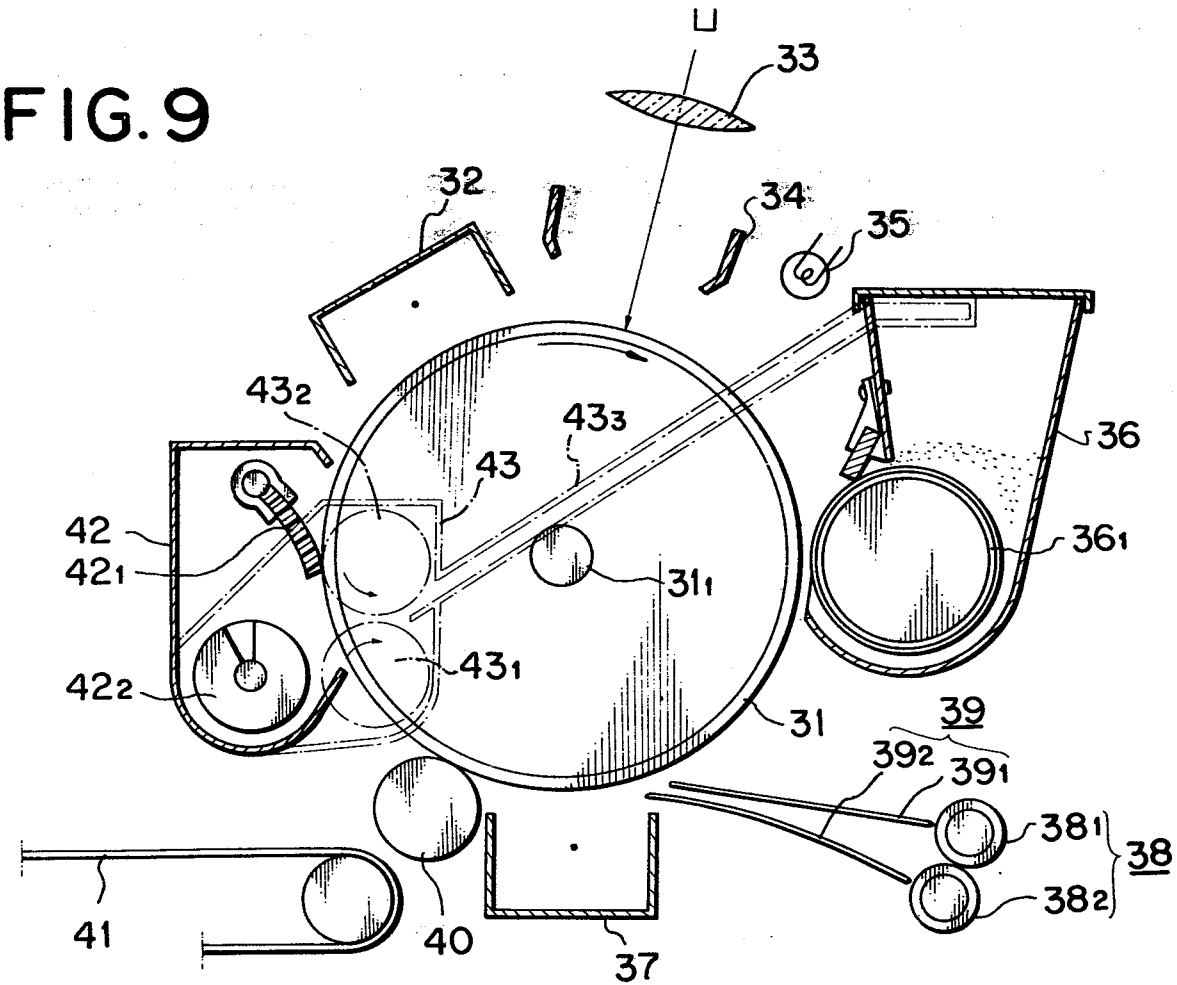
FIG. 9 is a side elevational view of a different embodient of the image forming device, to which the present invention is applied.

FIG. 9 illustrates a different embodiment of the image forming apparatus, in which the developer conveying method according to the present invention is used for conveying the developer recovered by the cleaning device to the developing device.

In the drawing, a reference numeral 31 designates a photosensitive drum having an insulative layer on its surface. Around the upper part of the photosensitive drum 31, there are disposed, as the means for forming an electrostatic latent image on this photosensitive drum surface, a primary corona discharger 32, an optical system 33 to expose an original light image L, a secondary corona discharger 34 to effect AC corona discharge simultaneously with the light image exposure or a corona discharge having an opposite polarity component to that of the primary corona discharge, and an overall exposure source 35 which effect the overall exposure. At the side of the downward rotation (right side in the illustrated construction) of the photosensitive drum 31, there are disposed a developing device 36. At the lower part of the drum, there is provided an image transfer corona discharger 37 to transfer the developed image onto an image transfer material. There are also provided, at this lower part of the drum, a pair of guide rollers 38 (composed of a roller $38_1$ and a roller $38_2$), guide members 39 (composed of a guide member $39_1$ and a guide member $39_2$), a separating member 40 to separate the image transfer material from the photosensitive drum after the image transfer operation, and a conveyor belt 41 to convey the separated image transfer material to an image fixing device (not shown). On the other hand, a cleaning device 42 to clean the surface of the photosensitive drum after the image transfer is disposed substantially at the center part of the other side (in the illustrated construction, the left side) of the drum, i.e., at the upward rotational side of the drum.

Figure 10:
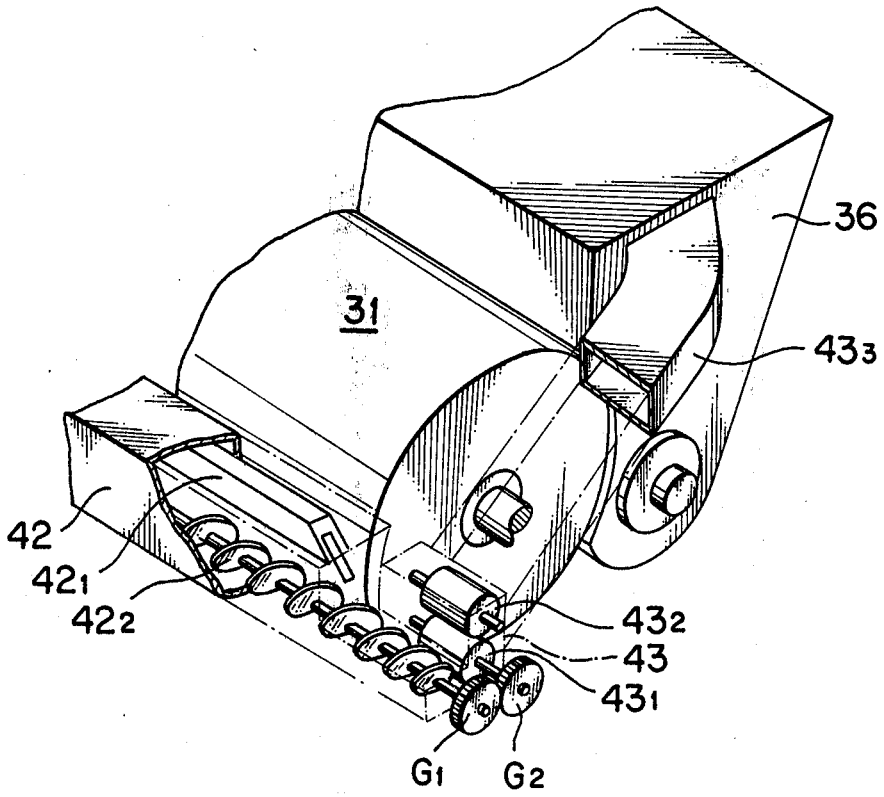
FIG. 10 is a perspective view of a part of the developer conveying device according to the present invention as shown in FIG. 9.

The cleaning device 42 includes a resilient cleaning blade $42_1$ to frictionally remove the developer remaining on the surface of the photosensitive drum, and a screw conveyor $42_2$ to transport the developer removed from the drum and recovered in the cleaning devvice to the sidewise direction. A developer conveying device 43 is disposed at a position where the developer as discharged by the screw conveyor $42_2$ of the cleaning device is to be received into this develper conveying device, as shown in the perspective view of FIG. 10. The developer conveying device 43 is of such a construction that a pair of magnetic rollers $43_1$ and $43_2$ are arranged substantially vertically at a location within a housing where they meet the abovementioned screw conveyor $42_2$.

A gear $G_2$ is fixedly provided at one side of the lower magnetic roller $43_1$ to be meshed with another gear $G_1$ fixedly provided at one end of the screw conveyor $42_2$ so as to obtain driving force therefrom. The upper magnetic roller $43_2$, if it is rotatably held, can rotate in accordance with rotation of the lower magnetic roller $43_1$. Needless to say, the gear $G_2$ may be fixedly provided on the upper magnetic roller to transmit driving power to the other roller. At the exist side of the slit-passageway formed by these adjacent magnetic rollers, there is positioned an inlet of the developer conveying path $43_3$. On the other hand, the exit of the conveying path $43_3$ is connected to a developer storing hopper section of the developing device 36.

By the rotation of the lower magnetic roller $43_1$ in the arrowed direction, the developer which has been sent into the conveying device is directed to the slit-shaped passageway. The developer which has passed through the minimum clearance section between both magnetic rollers is pushed out from the inlet of the developer conveying path $43_3$ into the hopper of the developing device 36. In this manner, the developer is given a conveying force at the terminal section of the cleaning device, and becomes movable into the developing device which is positioned above the discharging portion thereof through the developer conveying path which is merely a hollow passageway. As a consequence, the device becomes very compact in size as the conveying mechanism for re-use of the developer which is once used.

In the above-described embodiments, explanations have been given as to the construction, in which the magnetic roller is used. It is, of course, possible that any other construction such that magnets are disposed within a nonmagnetic sleeve and are rotated relative to the sleeve may also be effectively used.

In order to enable the skilled persons in the art to readily understand the invention and put it into practice, several preferred examples are presented, as follows.

EXAMPLE 1

In the device of a construction as shown in FIG. 4, eight-pole magnetic rollers, each having a diameter of 25 mm and a magnetic flux density of 1,000 gausses, in which N and S poles are alternately arranged, are used as the rotary magnetic rollers 13 and 14. A clearance of 2 mm is given between the two rollers, and the guide member 16 and the scrapers $17_1$ and $17_2$ are constructed with a stainless steel plate of 0.3 mm thick. By using a magnetic toner composed of 3 parts by weight of styrene resin and 1 part by weight of magnetite which are well mixed and pulverized, the magnetic rollers 13 and 14 are rotated at a speed of 60 rpm, whereupon the developer can be conveyed without scattering. Also, in the toner storing bin, there takes place no solidification of the developer.

In place of the abovementioned magnetic developer, a magnetic toner prepared by mixing and pulverizing 3 parts by weight of polyester resin and 1 part by weight of magnetite is mixed with carbon and spheroidized by the flow coater method, thereby obtaining an electrically conductive toner. When this magnetic toner is conveyed by use of the developer conveying device, satisfactory conveyance can be attained the same as in the case of the abovementioned developer. Moreover, the conveyed toner is in a very favorable condition without it being solidified, nor modified.

EXAMPLE 2

In the device of Example 1 above, an iron roller of 25 mm in diameter is used in place of the magnetic roller 14 to realize the construction in FIG. 5. When the experiment is performed under the same conditions as above, it is found that there is no scattering of the developer, nor solidification phenomenon.

EXAMPLE 3

In the device of Example 1 above, an iron plate of 2 mm thick is disposed alongside the magnetic roller 13 in place of the magnetic roller 14 to realize the construction as shown in FIG. 6. By elimination of the magnetic roller 14, the device become further compact in size and shape.

When the magnetic roller 13 is rotated at a speed of 60 rpm, the same good results as in Examples 1 and 2 above can be obtained.

EXAMPLE 4

In a device of a construction a shown in FIG. 7, six-pole magnetic rollers, each having a diameter of 22 mm and a magnetic flux density of 650 gausses, in which N and S poles are alternately arranged, are used as the rotary magnetic rollers 21 and 22. A clearance of 1 mm is provided between the two rollers, and the guide member 16 and the scrapers $17_1$ and $17_2$ are constructed with a stainless steel plate of 0.3 mm thick. A clearance of 0.5 mm is maintained between each scraper and the roller, and the magnetic roller is rotated at a speed of 40 rpm. The results obtained are as favorable as in the previous examples.

EXAMPLE 5

In the device of a construction shown in FIG. 8, a six-pole roller having a diameter of 20 mm and a magnetic flux density of 800 gausses, in which N and S poles are arranged alternately, is used as the rotary magnetic roller.

On the other hand, for the magnetizable roller to be the opposite magnetic pole, an iron roller of 20 mm in diameter is used. A clearance of 2 mm is provided between the two rollers, and they are rotated at a speed of 90 mm/sec. The photosensitive drum is rotated at a speed of 110 mm/sec.. The clearance between the photosensitive drum and the magnetic roller is 1 mm. Also, a clearance of 0.7 mm is provided between the magnetic roller and the scraper so that a layer of the developer may be formed on the surface of the magnetic roller to a thickness of about 1 mm. The gap between the guide plate 16 is set at 10 mm.

With the above-described construction of the device, cleaning operations are conducted in the manner as already mentioned in the previous examples. Excellent cleaning can be attained by the cooperative work of the resilient cleaning blade and the magnetic brush. The removed developer can be conveyed upward through the guide member by the cooperation of the magnetic roller and the iron roller.

EXAMPLE 6

In substitution for the planar opposite magnetic pole member in the device shown in FIG. 1, a magnetizable roller is provided, and the guide angle $\theta$ is varied.

Figure 11:
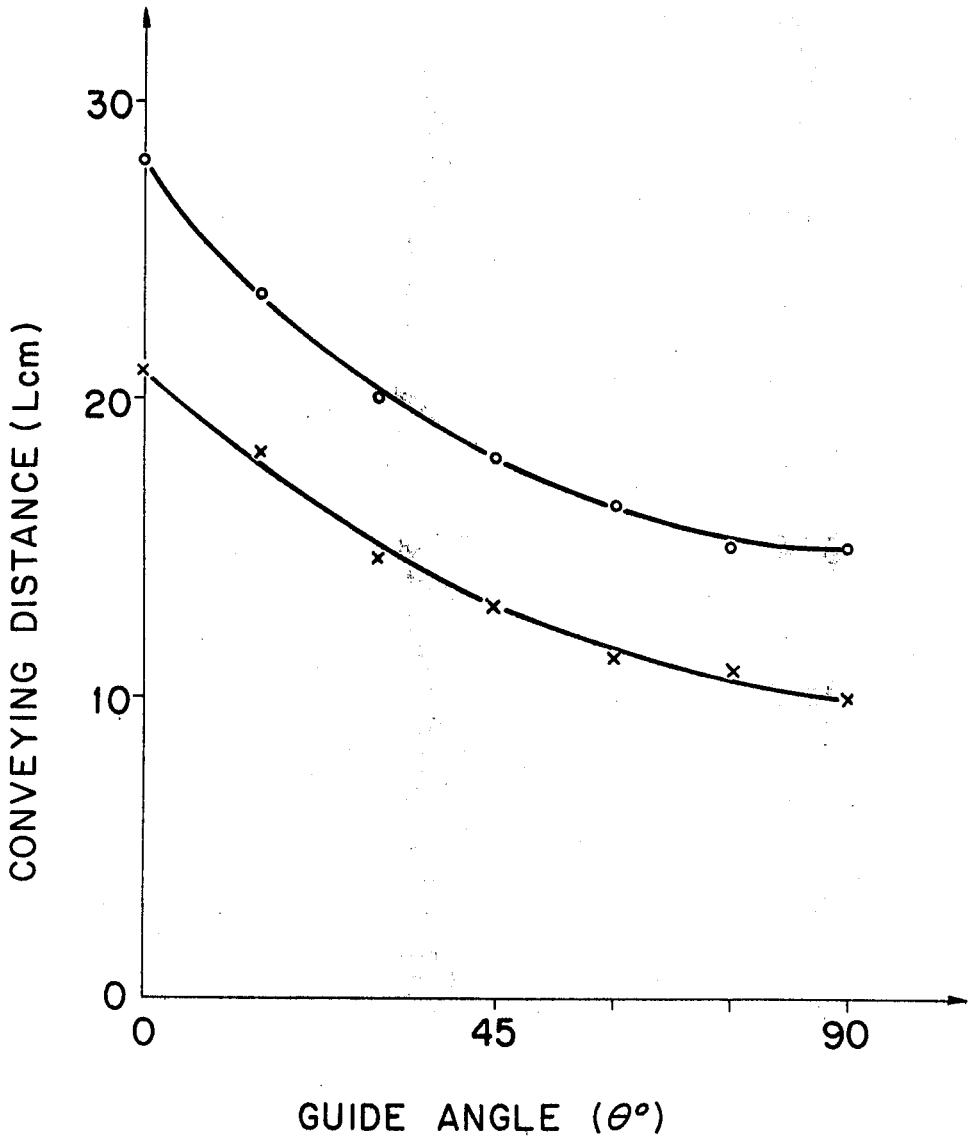
FIG. 11 is a graphical representation showing an inter-relationship between a guide angle and a conveying length or distance in the conveying device as shown in FIGS. 6 and 7.

Together with the upper and lower magnetic rollers, there is used a magnetic roller of 22 mm in diameter and a magnetic flux density of 1,100 gausses, in which N and S poles are arranged alternately. A space gap of 10 mm is provided in the guide plate, and a conveying distance is measured. The results are shown in FIG. 11 plotted with a mark (o), from which it will be understood that the developer can be satisfactorily conveyed upward in the vertical direction.

EXAMPLE 7

One of the magnetic rollers in Example 6 above is replaced by an iron roller of the same diameter, and the developer is conveyed by varying the guide angle $\theta$. The results are shown in FIG. 11 plotted with a mark (x). While the conveyance is slightly poorer than that in the case of using the magnetic rollers for both rollers, the developer is seen to be conveyed sufficiently in the vertical direction.

As stated so far with reference to preferred embodiments, the developer conveying device according to the present invention makes it possible to convey the magnetic developer with a device of highly compact size. Moreover, the conveying device of the present invention makes it possible to convey the magnetic developer in the upward direction, including even the substantially vertical direction. Since the present device is highly compact in size, it can be effectively utilized for the image forming apparatus of a small size using the magnetic developer.

It should be noted that the present invention is not limited to the above-described embodiments, but it has wide varieties of application on the basis of the subject of the present invention.

What is claimed is:

1. A method for conveying developing agent for use in an image forming apparatus which forms a developed image on an image bearing member using a magnetic developer, comprising the steps of:

(a) placing the magnetic developer under the influence of a forcing magnetic field;

(b) causing the developer restrained by the forcing magnetic field to pass through a slit-shaped passageway which narrows in gap to define a minimum clearance at a minimum clearance section;

(c) pushing out the developer into a developer conveying path by reducing the intensity of the forcing magnetic field with respect to the developer which has passed through the minimum clearance section of said slit-shaped passageway below the magnetic field intensity at the minimum clearance section; and (d) causing the developer which has been pushed out into said developer conveying path to move through said developer conveying path by subsequently transported developer.

2. The method as claimed in claim 1, wherein said forcing magnetic field is formed in a space between a magnetic roller having a plurality of magnetic poles and an opposite magnetic pole member.

3. The method as claimed in claim 2, wherein said magnetic roller and said opposite magnetic pole member are brought close to each other to form the slit-shaped passageway therebetween.

4. The method as claimed in claim 2, wherein said opposite magnetic pole member is made of a magnetizable material.

5. The method as claimed in claim 2, wherein said opposite magnetic pole member consists of a magnetic roller.

6. A method according to claim 2, wherein said magnetic roller rotates in a direction from the minimum clearance section toward the conveying path.

7. The method as claimed in claim 1, wherein said conveying path defines a space which extends upwardly in the conveyance direction of the developer.

8. A method for conveying developing agent for use in an image forming apparatus which forms a developed image on an image bearing member using a magnetic developing agent, and, after transfer of the developed image onto an image transfer material, the surface of the image bearing member is cleaned for re-use in subsequent image forming operations, comprising the steps of:

(a) placing the magnetic developing agent removed from the surface of the image bearing member under the influence of a forcing magnetic field;

(b) causing the developing agent restrained by the forcing magnetic field to pass through a slit-shaped passageway having a clearance which narrows to a minimum clearance at a minimum clearance section;

(c) pushing out the developing agent which has passed through the minimum clearance section of the slit-shaped passageway into a developer conveying path; and (d) causing the developing agent which has been pushed out into said conveying path to move through said conveying path under the thrust of subsequently transported developing agent.

9. A method for conveying developer agent for use in an image forming apparatus which forms a developed image on an image bearing member using a magnetic developing agent, and, after transfer of the developed image onto an image transfer material, the surface of the image bearing member is cleaned for re-use in subsequent image forming operations, the method comprising the steps of:

(a) placing the magnetic developing agent removed from the surface of the image bearing member under the influence of a forcing magnetic field:

(b) causing the developing agent restrained by the forcing magnetic field to pass through a slit-shaped passageway having a clearance which narrows to a minimum clearance at a minimum clearance section;

(c) pushing out the developing agent which has passed through the minimum clearance section of the slit-shaped passageway into a developer conveying path; and (d) causing the developing agent which has been pushed out into said conveying path to move through said conveying path toward a developing section under the thrust of subsequently transported developing agent.

10. A method for conveying developing agent for use in an image forming apparatus which forms a developed image on an image bearing member using a magnetic developer agent, transferring the developed image onto a transfer member, and then cleaning the image bearing member with a cleaning blade for re-use thereof, said method comprising the steps of:

(a) placing the magnetic developer which has been removed from the image bearing member with the cleaning blade under the influence of a forcing magnetic field;

(b) causing the developer restrained by the forcing magnetic field to pass through a slit-shaped passageway which narrows in gap to define a minimum clearance at a minimum clearance section.

(c) pushing out the developer into a developer conveying path by reducing the intensity of the forcing magnetic field with respect to the developer which has passed through the minimum clearance section of the slit-shaped passageway below the magnetic field intensity at the minimum clearance section; and (d) causing the developer which has been pushed out into the developer conveying path to move through said developer conveying path by subsequently transported developer.

11. A method according to claim 8, 9 or 10, wherein said forcing magnetic field is formed between a magnetic roller having a plurality of magnetic poles, and an opposite magnetic pole member.

12. A method according to claim 11, wherein said magnetic roller rotates in a direction from the minimum clearance section toward the conveying path.

13. A method according to claim 11, wherein said opposite magnetic pole member is made of a magnetic material.

14. A method according to claim 11, wherein said opposite magnetic pole member is a magnetic roll.

15. A method according to claim 14, wherein said opposite magnetic roll rotates in such a manner that the pole of said magnetic roller is substantially, at the minimum clearance section, opposed to the pole of the opposite magnetic roll, which is of opposite polarity to the polarity of the pole of said magnetic roller.

16. An apparatus for conveying developing agent for use in an image forming apparatus which forms a developed image on an image bearing member using a magnetic developing agent, comprising:

(a) a conveying path for the developing agent;

(b) a slit-shaped passageway connected to the inlet side of said developing agent conveying path, and having a clearance which narrows to a minimum clearance at a minimum clearance section;

(c) means for generating a forcing magnetic field to restrain said magnetic developing agent; and (d) means for causing the magnetic field generated by said magnetic field generating means to move along said slit-shaped passageway to push out the developing agent into said conveying path by reducing the intensity of the forcing magnetic field with respect to the developing agent which has passed through the minimum clearance section of said slit-shaped passageway below the magnetic field intensity at the minimum clearance section.

17. The apparatus as claimed in claim 16, wherein said developing agent conveying path has an upwardly inclined portion from the inlet side thereof.

18. The apparatus as claimed in claim 16 or 17, wherein said developing agent conveying path is defined by parallel surfaces having a clearance greater than the minimum clearance in said slit-shaped passageway.

19. The apparatus as claimed in claim 16 or 17, wherein said developing agent conveying path has a clearance which broadens from the inlet side and which is greater than the minimum clearance in said slit-shaped passageway.

20. The apparatus as claimed in claim 16, wherein said magnetic field generating means comprises a rotatable magnetic roller having a plurality of magnetic poles, and an opposite magnetic pole member.

21. The apparatus as claimed in claim 20, wherein said opposite magnetic pole member is made of a magnetizable material.

22. The apparatus as claimed in claim 20 or 21, wherein said opposite magnetic pole member is in the shape of a roller.

23. The apparatus as claimed in claim 20, wherein said opposite magnetic pole member is a magnetic roll.

24. An apparatus for conveying developing agent for use in an image forming apparatus which forms a developed image on an image bearing member using a magnetic developing agent, and, after transfer of the developed image onto an image transfer material, the surface of the image bearing member is cleaned for re-use in subsequent image forming operations, comprising:

(a) a developing agent conveying path having an inlet and an exit for conveying the developing agent into an image developing section;

(b) a slit-shaped passageway having a clearance which narrows to a minimum clearance at a minimum clearance section for leading the developing agent removed by a cleaning blade into the inlet of the developing agent conveying path;

(c) magnetic field generating means for generating a forcing magnetic field to restrain the magnetic developing agent; and (d) means for causing the magnetic field generated by said magnetic field generating means to move along said slit-shaped passageway to push out the developing agent into said conveying path by reducing the intensity of the magnetic field with respect to the developing agent which has passed through the minimum clearance section of said slit-shaped passageway below the magnetic field intensity at the minimum clearance section.

25. The apparatus as claimed in claim 24, wherein the exit side of said developing agent conveying path is positioned above a horizontal plane at the inlet side thereof.

26. The apparatus as claimed in claim 24 or 25, wherein said developing agent conveying path is defined by parallel surfaces having a clearance greater than the minimum clearance in said slit-shaped passageway.

27. The apparatus as claimed in claim 24 or 25, wherein said developing agent conveying path has a further clearance which broadens from the inlet and which is greater than the minimum clearance in said slit-shaped passageway.

28. The apparatus as claimed in claim 24, wherein said magnetic field generating means comprises a rotatable magnetic roller having a plurality of magnetic poles, and an opposite magnetic pole member.

29. The apparatus as claimed in claim 28, wherein said opposite magnetic pole member is made of a magnetizable material.

30. The apparatus as claimed in claim 28 or 29, wherein said magnetic pole member is in the shape of a roller.

31. The apparatus as claimed in claim 28, wherein said opposite magnetic pole member is a magnetic roll.

32. The apparatus as claimed in claim 28, wherein said magnetic roller is close to the surface of the image bearing member to perform the cleaning operation on said surface.

33. Apparatus according to claim 23 or 31, wherein said opposite magnetic roll rotates in such a manner that the pole of said magnetic roller is substantially, at the minimum clearance section, opposed to the pole of the opposite magnetic roll, which is of opposite polarity to the polarity of the pole of said magnetic roller.

* * * * *

UNITED STATES PATENT AND TRADEMARK OFFICE

CERTIFICATE OF CORRECTION

PATENT NO. : 4,252,434

DATED : February 24, 1981

INVENTOR(S) : SHUNJI NAKAMURA, ET AL.

It is certified that error appears in the above-identified patent and that said Letters Patent are hereby corrected as shown below:

Column 1, line 58, after "mix" insert --into--;

Column 8, lines 32 and 33, delete "only a" and insert --the-- and after "since" delete "the" and insert --only a single--;

Column 8, line 58, delete "an arrowed";

Column 9, line 24, "mgnetizable" should read --magnetizable--;

Column 9, line 30, after "can" insert --only--;

Column 10, line 14, "develper" should read --developer--;

Column 10, line 29, "exist" should read --exit--.

Signed and Sealed this

*Eighth* Day of *September 1981*

[SEAL]

*Attest:*

GERALD J. MOSSINGHOFF

*Attesting Officer*

*Commissioner of Patents and Trademarks*